United States Patent [19]

Clemens et al.

[11] 4,157,938

[45] Jun. 12, 1979

[54] METHOD AND APPARATUS FOR CONTINUOUSLY EXPELLING AN ATOMIZED STREAM OF WATER FROM A MOVING FIBROUS WEB

[75] Inventors: Matthew L. Clemens; Wendell J. Morton, both of Cincinnati, Ohio

[73] Assignee: The Procter & Gamble Company, Cincinnati, Ohio

[21] Appl. No.: 789,609

[22] Filed: Apr. 21, 1977

[51] Int. Cl.[2] ..... D21F 11/00

[52] U.S. Cl. ..... 162/207; 34/16; 34/155; 162/208; 162/290; 162/307; 162/308

[58] Field of Search ..... 162/205–207, 162/275, 279, 307, 306, 290, 117, 301, 303, 203, 297, 115, 208, 308, 217; 34/16, 115, 122, 155, 23; 15/306 A

[56] References Cited

U.S. PATENT DOCUMENTS

| | | | |
|---|---|---|---|
| Re. 28,459 | 7/1975 | Cole et al. | 34/6 |
| 1,549,338 | 8/1925 | Tompkins | 162/206 |
| 1,843,656 | 2/1932 | Tompkins et al. | 162/206 |
| 2,441,169 | 5/1948 | Roman | 162/206 |
| 2,753,766 | 7/1956 | Simpson | 162/297 |
| 3,284,285 | 11/1966 | Holden | 162/297 |
| 3,301,746 | 1/1967 | Sanford et al. | 162/206 |
| 3,303,576 | 2/1967 | Sisson | 34/115 |
| 3,320,675 | 5/1967 | Chaikin | 34/16 |
| 3,447,247 | 6/1969 | Daane | 34/122 |
| 3,657,069 | 4/1972 | Candor et al. | 162/205 |
| 3,810,818 | 5/1974 | Arledter | 162/301 |
| 3,812,000 | 5/1974 | Salvucci et al. | 162/111 |
| 3,821,068 | 6/1974 | Shaw | 162/111 |
| 3,879,257 | 4/1975 | Gentile et al. | 162/112 |

FOREIGN PATENT DOCUMENTS

| | | | |
|---|---|---|---|
| 2312072 | 9/1974 | Fed. Rep. of Germany. | |
| 889244 | 2/1962 | United Kingdom | 162/306 |

*Primary Examiner*—Richard V. Fisher
*Assistant Examiner*—Peter Chin
*Attorney, Agent, or Firm*—E. Kelly Linman; John V. Gorman; Richard C. Witte

[57] ABSTRACT

A web dewatering concept which has particular utility in papermaking processes wherein overall compression and compaction of the paper web by mechanical means is avoided comprising a high pressure jet of compressible fluid such as air or steam emitting from a slot extending across the entire width of the web. The web is constrained between a pair of foraminous supporting members while it is passed across a slotted nozzle expelling a jet of compressible fluid at pressures up to about 50 psig. The jet of compressible fluid scrubs the free water from the spaces between the fiber matrix of the web and the foraminous supporting members. The edges of the slotted nozzle make intimate contact with and form a seal against the interior surface of the foraminous supporting member closest the nozzle. This causes direct penetration of the web and the carrying members by the fluid jet, thereby continuously expelling an atomized stream of moisture from the web. The jet is operated at pressures $P<T/R$ where $T$=tension in the foraminous support member furthest removed from the nozzle and $R$=minimum radius said foraminous support member is capable of assuming across the slotted nozzle without lift-off of the composite structure at the nozzle and consequent sheet disruption.

16 Claims, 7 Drawing Figures

METHOD AND APPARATUS FOR CONTINUOUSLY EXPELLING AN ATOMIZED STREAM OF WATER FROM A MOVING FIBROUS WEB

BACKGROUND OF THE INVENTION

The use of compressible fluid jets operating across the surface of a moist paper web and discharging into a suction box to dewater and/or to transfer the web from one foraminous surface to another are well known in the art. U.S. Pat. Nos. 1,549,338 issued to Tompkins on Aug. 11, 1925, 1,843,656 issued to Tompkins et al. on Feb. 2, 1932, 3,301,746 issued to Sanford et al. on Jan. 31, 1967, and 3,879,257 issued to Gentile et al. on Apr. 22, 1975 are representative of such prior art structures. It is noteworthy, however, that in such prior art apparatus the nozzle means are in each case spaced a distance away from the web and the foraminous member on which the web is supported. There is no seal between the slotted nozzle and the foraminous web supporting member. The lack of intimate contact between the nozzle slot and the foraminous supporting member and the resultant leakage of compressible fluid prevent direct pressure application to the composite structure comprising the foraminous supporting members and the moist paper web constrained therebetween. Such prior art nozzles blowing against the web change pressure in the nozzle header to velocity through the nozzle and then back to pressure at the interface with the foraminous supporting members and the moist paper web.

Prior art devices which have the capability of applying a high pressure compressible fluid directly across the surface of the web are also known. U.S. Pat. No. 3,284,285 issued to Holden on Nov. 8, 1966 discloses a perforated roll which acts to constrain a moist paper web against a foraminous fabric while discharging high pressure air from its periphery and into a suction box located adjacent the lowermost surface of the foraminous web supporting member. U.S. Pat. No. 3,657,069 issued to Candor et al. on Apr. 19, 1972 employs a movable nozzle means in the form of a continous belt operating about a pair of rolls. The belt is internally pressurized and has a plurality of openings along its periphery which serve to discharge high pressure air across the moving, moist paper web and into a suction box located beneath the surface of a foraminous web supporting member. U.S. Pat. No. 2,753,766 issued to Simpson on July 10, 1956 discloses another prior art perforate belt apparatus for web dewatering.

U.S. Pat. No. 3,447,247 issued to Daane on June 3, 1969 discloses a low-pressure apparatus for removing moisture from a lightweight paper web by impinging drying air on the web at high velocity, whereby the momentum of the high velocity air causes it to penetrate the web. According to the teachings of Daane, penetration of the web by the high velocity air increases the exposure of internal web fibers to the evaporative effect of the air, which is preferably heated, and also physically blows or pushes moisture particles through and out of the web. The apparatus of Daane preferably employs a plurality of slotted nozzles in spaced, generally parallel adjacency to the surface of an unconstrained web opposite the foraminous support member, said nozzles preferably operating at pressures on the order of about 30 inches of water. U.S. Pat. No. 3,810,818 issued to Arledter on May 14, 1974 discloses a twin wire papermaking machine having suction boxes within the loop of one wire and hot air blast boxes within the other arranged in serpentine fashion. The boxes employ a perforated convex domed wire supporting wall and are preferably utilized in combination with one or more elements selected from the group comprising foils, suction cylinders, press cylinders, grooved cylinders, and the like.

The prior art completely fails, however, to teach or disclose a fixed, slotted nozzle which discharges a high pressure jet of compressible fluid and which forms a seal against the innermost surface of a traveling formainous support member to dewater a moist paper web secured between said first traveling foraminous support member and a second traveling foraminous support member, said support members and said fibrous web being maintained in a unified condition by means of tension in the second foraminous member sufficient to prevent lift-off of the composite structure at the nozzle.

OBJECTS OF THE INVENTION

Accordingly, it is an object of the present invention to provide method and apparatus for continuously expelling an atomized stream of moisture from a moving fibrous web without subjecting said web to mechanical compaction between opposed mechanical members such as rolls.

It is a further object of the invention to provide method and apparatus for improving the Z-direction bulk of the finished web due to greater penetration of a foraminous support member by the web.

It is yet another object of the present invention to provide method and apparatus capable of either increasing papermachine productivity without increasing thermal energy usage for web drying or maintaining papermachine productivity constant while decreasing thermal energy usage for web drying.

It is another object of the present invention to provide improved web dewatering method and apparatus which may be utilized to aid in the transfer of a moving fibrous web from one foraminous supporting surface to another.

SUMMARY OF THE INVENTION

In a particularly preferred embodiment, a nondestructive method for continuously expelling an atomized stream of moisture from a traveling moist fibrous web comprising the following steps is provided:

(1) supporting the moist fibrous web on the exterior surface of a first traveling foraminous support member having an interior and exterior surface;

(2) superposing on said moist fibrous web and said first traveling foraminous support member, a second traveling foraminous support member to form a traveling composite structure;

(3) directing said traveling composite structure across a stationary pressure plenum connected to a source of compressible fluid maintained at pressure P, said pressure plenum having a slotted orifice extending continuously in a direction substantially perpendicular to the direction of travel of said composite structure across the entire width of said fibrous web;

(4) applying tension T, to said second traveling foraminous support member as it crosses said slotted orifice in accordance with the relation T is greater than $P \times R$, where P=pressure of the compressible fluid supplied to said stationary plenum and R=minimum radius of curvature which said second traveling foraminous support member is capable of assuming across said slotted orifice when said composite structure is maintained in a unified condition and the interior surface of said first traveling foraminous support member is maintained in sealed relation to the edges of said slotted orifice; and (5) directing a continuous jet of said compressible fluid from said slotted orifice directly through said composite structure as it crosses said slotted orifice, thereby continuously expelling an atomized stream of moisture from said traveling moist fibrous web.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

DESCRIPTION OF THE PREFERRED EMBODIMENTS

Figure 1:
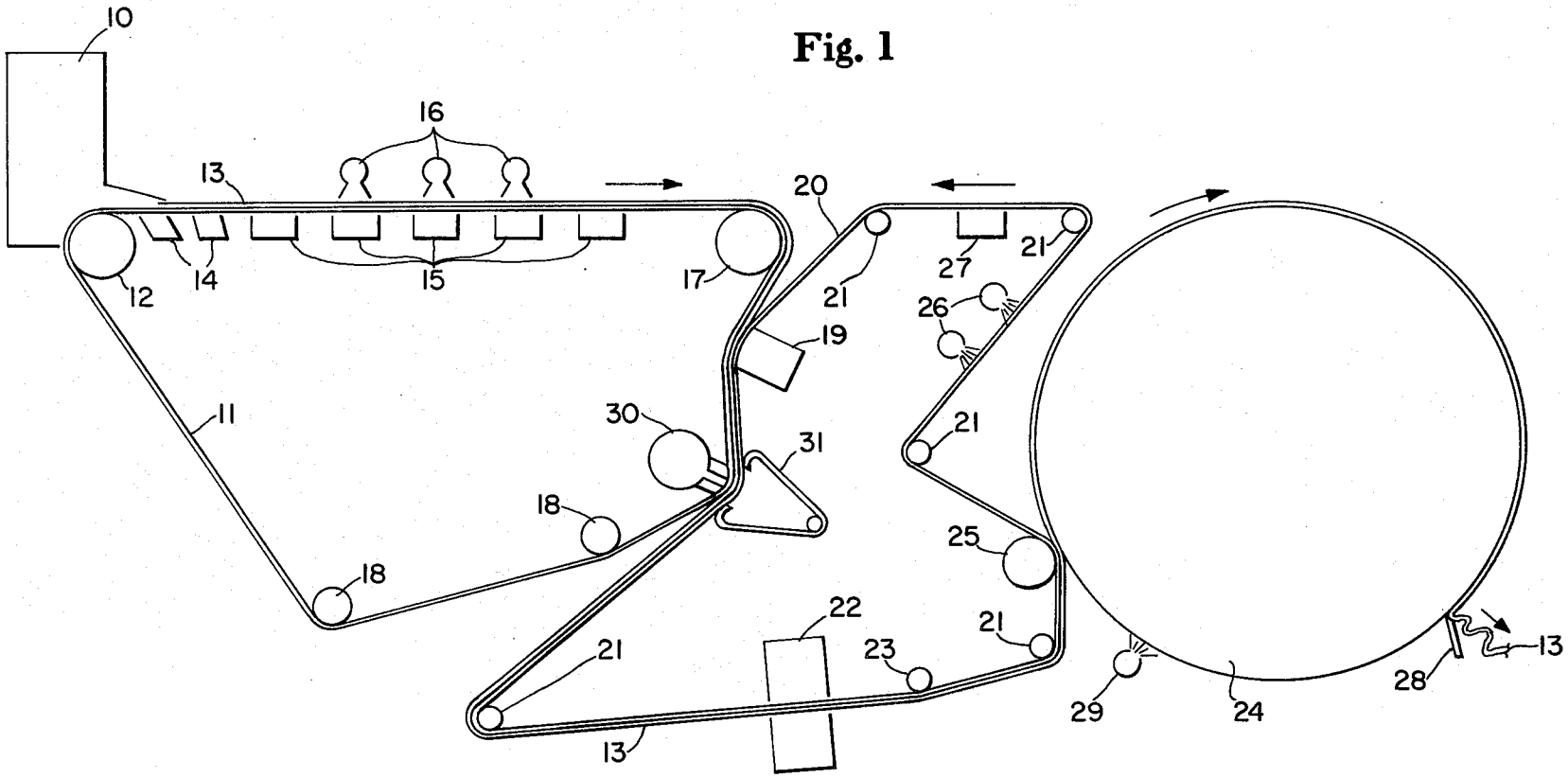
FIG. 1 is a simplified schematic illustration of a papermaking machine employing a preferred embodiment of the present invention.

As is well known to those skilled in the papermaking industry, the moisture contained in a formed fibrous web comprises two distinct components: the free water in the fibrous matrix and the foraminous supporting membrane or membranes which can be removed by mechanical means; and the bound water which is internal to the web fibers and which can be removed only by thermal means. Free water can more specifically be broken down into two categories: the interstitial portion which is contained in the interstitial voids between the individual fibers of the web and between the filaments of the foraminous supporting member or members; and the restrained portion which is held to the individual fibers and the filaments of the foraminous members by surface tension. Interstitial water has typically been squeezed or pressure from fibrous webs by prior art techniques employing porous felts. However, interstitial water pressed from a fibrous web into a porous felt tends to migrate into and rewet the fibrous web as soon as the pressing force is released. Improvements such as grooved press rolls, blind drilled, and drilled suction press rolls have been developed with the objective of providing additional space for the water expelled from the web and thereby improving the dewatering efficiency of the process. Grooved and drilled hole area is limited, however, by the need to retain the roll's structural rigidity to resist the imposed load which is necessary to effect water removal. Consequently, the grooves or holes must be spaced apart. The interstitial water in the sandwich which is directly above the open area passes immediately into the cavity when pressure is applied. However, the interstitial water which is not aligned with a groove or hole must move laterally to the nearest cavity before it can exit. Removal time is therefore established by the distance the water must travel and the allowable nip pressure to produce the pressure driving force to accelerate the water to an available exit point. This type of water removal is further limited because excessive nip loads can result in fibrous web disturbance or bursting as the water moves to an exit point. Furthermore, the excessive fibrous web compaction or crushing which results is particularly undesirable in a low density papermaking process.

More recent developments in the prior art which avoid the foregoing problems have embodied the use of water boxes, hydrofoils and/or vacuum boxes to remove interstitial water from a moving fibrous web supported on a foraminous member. These devices, individually or staged to provide a systematic increase in driving force have given an increased efficiency in water removal because they present, at least in some cases, a continuous open area in the cross-machine direction, thereby reducing the distance the moisture must travel to exit the web. These devices are speed limited, however, because the differential pressure driving force obtainable by means of vacuum is limited to about 0.8 atmospheres or less.

The present development relies upon the use of pressure rather than vacuum to obtain as much as six times the driving force of current papermaking industry practice in a vacuum water removal process. By utilizng a pair of foraminous members to constrain the fibrous web during the dewatering process, the increased driving force does not adversely affect finished product attributes, but rather, serves to enhance its bulk. The present process is capable of functioning at extremely high speed, i.e., web speeds in excess of 6,000 feet per minute, on tissue weight fibrous webs because the compressible fluid jet extending completely across the web provides a many fold increase in driving force coupled with a significant reduction in the distance that the free water must be moved to exit the web. It has also been found feasible to remove a portion of the restrained water from the laminate structure comprising the foraminous support members and the moist fibrous web by proper sizing of the nozzle orifice. Since the prior art practice has been to utilize thermal drying to effect restrained water removal, thermal energy savings beyond those obtained by removal of the interstitial water are thus obtainable.

While the present invention may be practiced in conjunction with nearly any papermaking process wherein a moist fibrous web is constrained between a pair of foraminous support members, the process is particularly useful in low density papermaking processes wherein it is desirable to avoid overall compaction of the web, at least while the web is at relatively low fiber consistency. In this regard, the processes disclosed in U.S. Pat. Nos. 3,301,746 issued to Sanford et al. on Jan. 31, 1967 and 3,994,771 issued to Morgan et al. On Nov. 30, 1976, said patents being hereby incorporated herein by reference, are particularly well suited to the practice of the present invention.

FIG. 1 shows an example of a papermaking machine employing a preferred embodiment of the present invention. A papermaking furnish is delivered from a closed headbox 10 to a Fourdrinier wire 11 supported by a breast roll 12. A moist paper web 13 is formed, and the Fourdrinier wire passes over forming boards 14, which are desirable, but not necessary. Toward the dry end of the forming section, the Fourdrinier wire 11 with the moist paper web 13 supported thereon passes over a plurality of suction boxes 15. Steam nozzles 16 may be employed in conjunction with the vacuum boxes. After passing over the vacuum boxes 15 the Fourdinier wire and the moist paper web pass around a Fourdinier wire return roll 17 and downwardly to a vacuum pickup shoe 19. At this point, the paper web 13 contacts a selected imprinting fabric 20 and continues in a constrained fashion between the Fourdinier wire 11 and the imprinting fabric 20 between a slotted compressible fluid nozzle 30 and a suction box 31 located at the interior surface of the imprinting fabric run. The slotted compressible fluid nozzle 30 forms a seal against the interior surface of the Fourdinier wire 11 to substantially prevent the leakage of compressible fluid between the edges of the nozzle orifice and the interior surface of the Fourdinier wire. Since the moist paper web 13, which could be easily damaged if not restrained, is held captive between two foraminous supporting surfaces, i.e., the Fourdrinier wire 11 and the imprinting fabric 20, a high pressure jet of compressible fluid such as air is utilized to scrub the free water from the interstices of both the fiber matrix of the web and the support members. Because of the direct penetration of the web and the carrying fabrics by the fluid jet extending completely across the web, an atomized stream of moisture is continuously expelled from the web into the suction box 31. The Fourdinier wire 11 is thereafter subject to a cleansing operation by means (not shown) which are well known in the art and is directed around Fourdrinier wire return rolls 18 and back to the breast roll 12.

After passing the jet of compressible fluid issuing from slotted nozzle 30, which also serves to transfer allegiance of the web to the imprinting fabric 20, the fibrous web 13 remains in contact with the imprinting fabric which passes about an imprinting fabric return roll 21 and preferably to a hot air thermal dryer 22 such as is described in U.S. Pat. No. 3,303,576 issued to Sisson on Feb. 14, 1967 and hereby incorporated herein by reference. The imprinting fabric and the thermally predried paper web then pass over a straightening roll 23, which prevents the formation of wrinkles in the imprinting fabric, and over another imprinting fabric return roll 21 onto the surface of a Yankee dryer drum 24. The knuckles of the imprinting fabric 20 are then impressed into the thermally predried paper sheet 13 by the pressure roll 25. The imprinting fabric 20 returns to the Fourdinier wire 11 over several imprinting fabric return rolls 21, being washed free of clinging fibers by water sprays 26 and dried by a vacuum box 27 during its return. The impressed paper sheet 13 continues from the impression nip roll 25 along the periphery of the Yankee dryer drum 24 for final drying and is desirably creped from the Yankee dryer surface by a doctor blade 28. If desired, the surface of the Yankee dryer can be sprayed with a small amount of adhesive solution from spray nozzle 29 to improve the bond between the knuckle imprints of the paper sheet and the Yankee dryer surface during drying.

Figure 2:
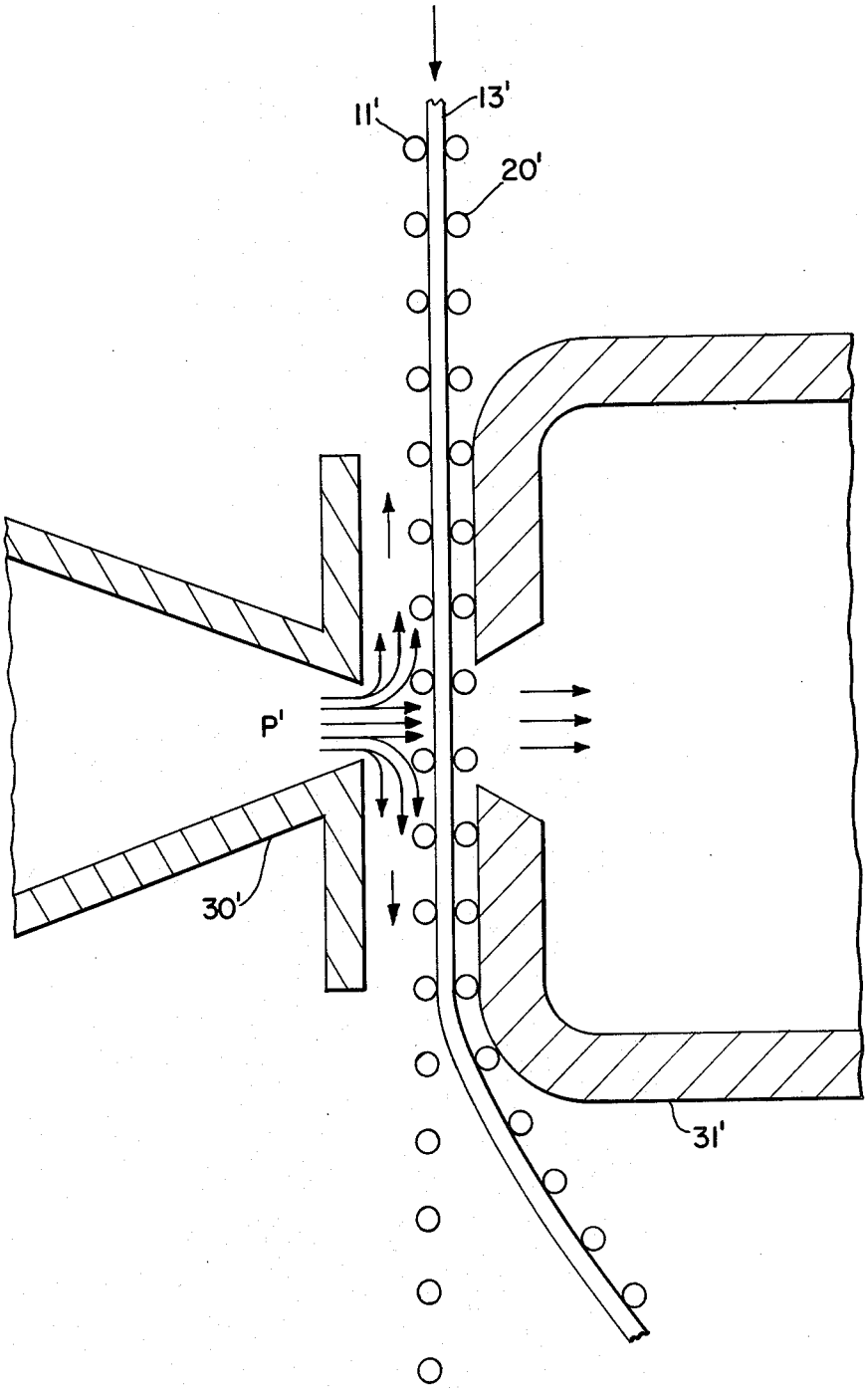
Fig. 2 Prior Art
FIG. 2 is an enlarged, simplified schematic illustration of a commonly used prior art technique for dewatering and/or transferring a moist fibrous web.

FIG. 2 depicts a typical prior art dewatering apparatus which may also be utilized to effect a web transfer of the type generally described in the aforementioned patents to Sanford et al. and to Morgan et al. A slotted nozzle 30' located near, but not in contact with a Fourdrinier wire 11', impinges a jet of compressible fluid at pressure P' against the innermost surface of the Fourdrinier wire. In addition to providing a web dewatering effect, the jet is utilized to aid in transferring allegiance of a moist paper web 13' from the Fourdrinier wire to the surface of an imprinting fabric 20'. A suction box 31' is located at the innermost surface of the imprinting fabric 20'. As is apparent from the illustration, the lack of a seal between the nozzle 30' and the Fourdrinier wire 11' permits a substantial portion of the compressible fluid emanating from the slotted nozzle to escape along the path of least resistance without being forced to penetrate the foraminous support members and the moist paper web constrained therebetween.

Figure 3:
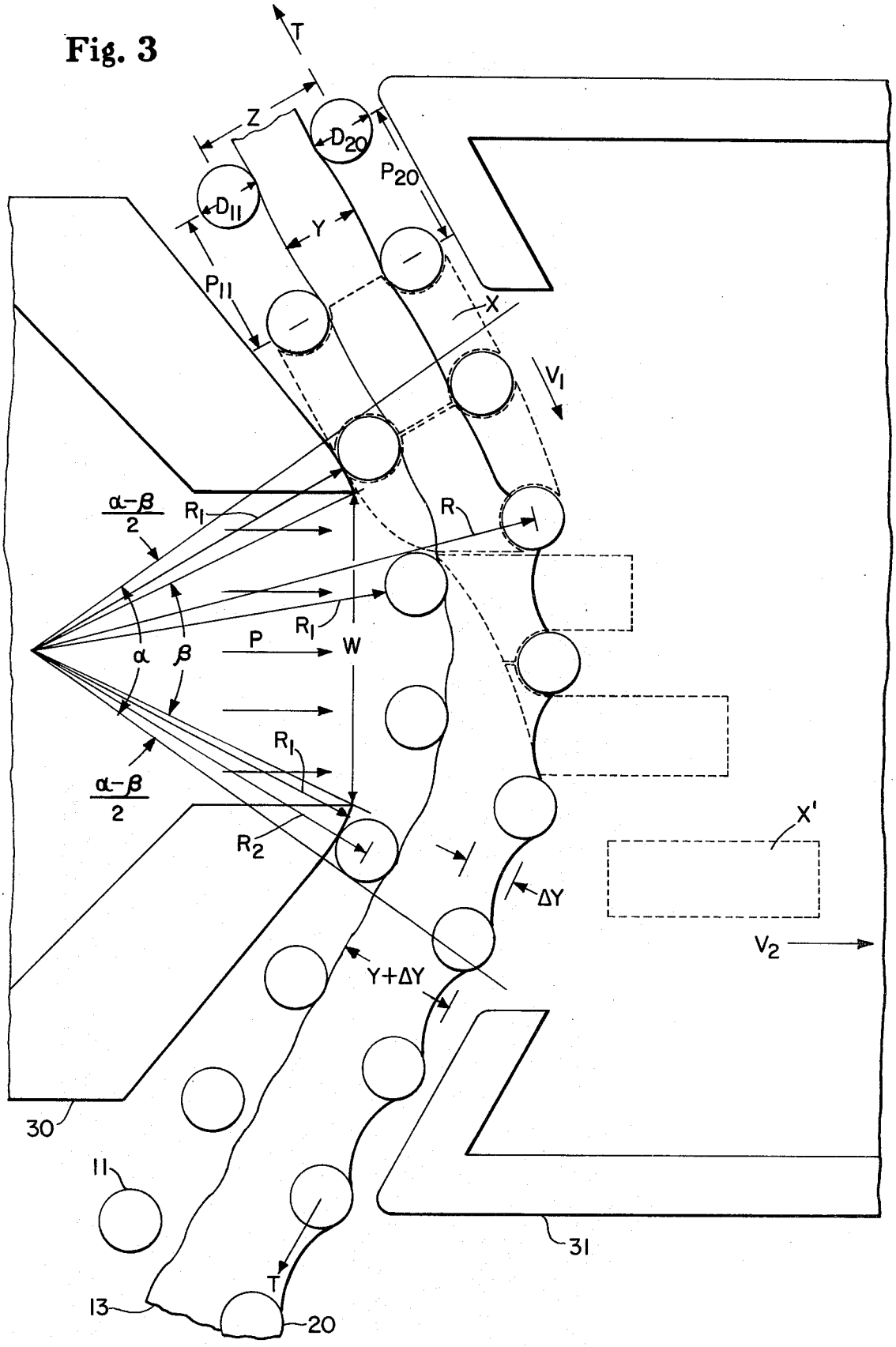
FIG. 3 is an enlarged, simplified schematic cross-sectional illustration of a segment of the slotted nozzle and suction box illustrated in FIG. 1 depicting the condition prevailing when $P=T/R$.

FIG. 3 is an enlarged cross-sectional view of the slotted nozzle 30 and suction box 31 illustrated in FIG. 1. In particular, a variable pressure, compressible fluid source is placed in intimate contact with the innermost surface of a moving, foraminous sandwich comprising Fourdinier wire 11, moist fibrous web 13 and impriting fabric 20. As has been pointed out earlier herein, a critical feature of the present invention is that the edges of the nozzle orifice make intimate contact with the interior surface of the foraminous support member to form a seal which substantially prevents the escape of compressible fluid from the nozzle. This causes direct penetration of the web and the carrying fabrics by the fluid jet, thereby continuously expelling an atomized stream of moisture from the web. Operation of the slotted nozzle 30 at jet pressures below $P=T/R$, where $I$=tension in the foraminous support member 20 furthest removed from the surface of the nozzle, and $R$=minimum radius of curvature the outermost foraminous support member 20 is capable of assuming across the orifice W of the slotted nozzle without lift-off of the composite structure, i.e., the laminate sandwich, at the nozzle. Thereby prevents the innermost foraminous support member 11, the web 13 and the outermost foraminous support member 20 from separating. Operating the compressible fluid jet at pressures greater than $P=T/R$ results in lift-off of the composite structure at the nozzle causing a loss of dewatering efficiency and sheet disruption due to separation of the foraminous support members and the fibrous web from one another.

As is illustrated in FIG. 3, which represents the limiting condition of $P=T/R$, the outermost foraminous support member 20 assumes an in-use radius of curvature R across the width of the nozzle orifice W based on the pressure P of the compressible fluid jet and the tension T in the foraminous imprinting fabric 20. The corresponding radius $R_2$ assumed by the innermost foraminous support member 11 is equal to $R-Z$, where $Z$=radial distance between the two foraminous support members. The innermost surface of foraminous support member 11 assumes a radius $$R_1 = R_2 - \left(\frac{D_{11}}{2}\right)$$

where $D_{11}$=diameter of the cross-machine direction extending filaments in the foraminous support member 11. In order to effect a seal, the surface of the nozzle 31 adjacent the orifice W must also exhibit a radius $R_1$. The angle $\beta$ represents the included angle formed by radial lines directed to the edges of the nozzle orifice W. The radius $R_1$ must, however, be maintained through an included angle $\alpha$ sufficient to provide sealing surfaces at the edges of the nozzle orifice W to prevent the escape of compressible fluid at these points. Accordingly, the size of the included angle $\alpha$ will depend upon such variables as the width of the orifice W, the mesh count of the foraminous support member 11 and the diameter of the cross-machine direction filaments employed therein. If the included angle $\alpha$ is too small, a portion of the compressible fluid jet will escape due to lack of a seal between the edges of the nozzle orifice W and the foraminous support member 11. If the angle $\alpha$ is, on the other hand, larger than necessary to effect a seal, a higher than necessary friction force is generated by the foraminous support member 11 as it is drawn across the surface of the nozzle 30. The latter alternative will function in the practice of the present invention, but will involve greater power consumption and increased wear of the foraminous support member due to the greater load imposed by the normal component of the tension force, T. In practice, the optimum value of the included angle $\alpha$ for a given foraminous support member is determined experimentally by finding the point at which leakage of the compressible fluid jet is initiated and then increasing the angle just enough to eliminate the leakage.

Figure 7:
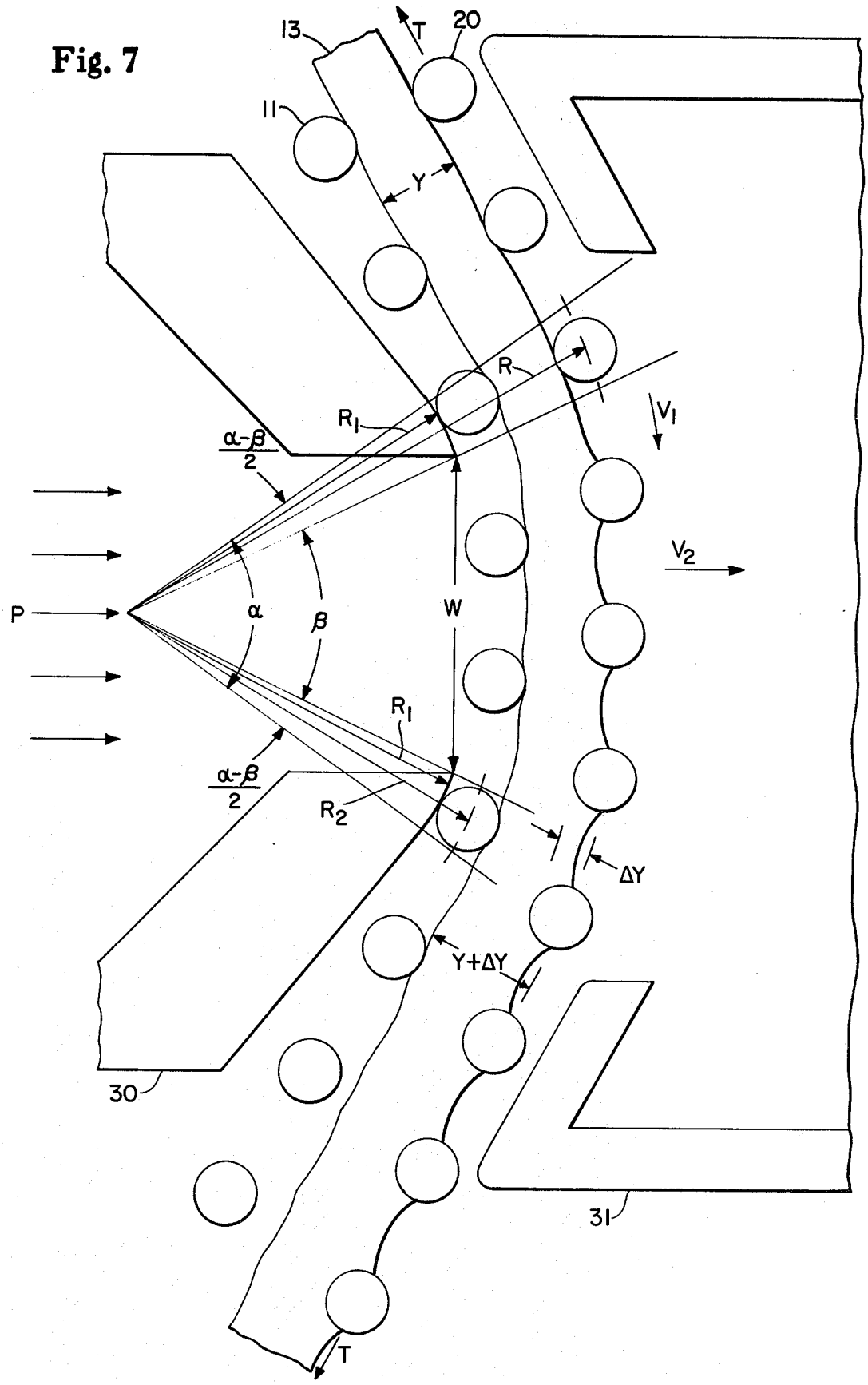
FIG. 7 is an enlarged, simplified schematic cross-sectional illustration similar to that of FIG. 3 depicting the condition prevailing when $P<T/R$.

It should be noted that FIG. 3 represents the limiting condition prevailing when P=T/R. In practice, it is imperative that P be less than T/R to avoid lift-off of the sandwich. Consequently, when the pressure is reduced below P=T/R, the radius of curvature actually assumed by the foraminuous support member 20 in the sandwich across the nozzle orifice W will change and approach a planar condition as illustrated in FIG. 7. In the latter situation, a seal is still maintained, however, by the shape of the nozzle surface adjacent the orifice W. A sealing surface having a radius $R_1$ extending through an included angle amounting to $(\alpha-\beta)/2$ is located on either side of the nozzle orifice W. Thus FIG. 7 represents the actual inuse condition of a preferred embodiment of the present invention.

In a most preferred embodiment of the present invention, the compressible fluid jet applied to the moist fibrous web constrained between the foraminous support members provides a uniform pressure driving force in the cross-machine direction against the free water contained in the moving foraminous sandwich. The width of the nozzle orifice W may be either fixed or adjustable in order to maintain a proper relationship between the available kinetic energy of the dewatering jet and the papermachine speed.

In a particularly preferred embodiment, a forcemass balance equation is utilized to establish the desired orifice width W for a given papermachine speed, a given set of foraminous support members and a moist fibrous web having a predetermined thickness and fiber consistency in the manner hereinafter described. The following derivations are, for simplification, based upon inviscid flow, i.e., a fluid having no viscosity.

The force-mass balance equation is expressed as follows:

$$F = Ma = \left(\frac{w}{g}\right)a \tag{1}$$

where

F=the driving force applied to the free water contained in the sandwich, $$Ma = \text{Mass of free water contained in the sandwich} = \left(\frac{w}{g}\right) = \left(\frac{\text{weight of free water contained in the sandwich}}{\text{acceleration due to gravity}}\right),$$

and a=acceleration imparted by F to the free water contained in the sandwich.

$$F=PA \tag{2}$$

where

P=pressure of the compressible fluid and

A=projected cross-sectional area acted upon by P. Thus, $$Ma=PA. \tag{3}$$

Substituting in (3):

$$PA = \left(\frac{\rho_H A\ Ts\ K}{g}\right)a \tag{4}$$

where

P=pressure of the compressible fluid,

A=projected cross-sectional area of the nozzle orifice, $\rho$=density of the water contained in the sandwich, Ts=total thickness of the sandwich as determined by means of a standard micrometer measurement, a=acceleration as defined above, g=acceleration due to gravity, and K=ratio of the weight of the free water contained in the saturated sandwich to the total weight of the saturated sandwich. A value for K, which is based on an assumed saturated condition of the sandwich, is determined experimentally as follows:

(a) a 6" by 6" unit area of each of the components of the laminate sandwich, i.e., the foraminous support members and the fibrous web, is prepared;

(b) each of the components is placed in an oven and dried at a temperature of approximately 225° F. for a period of one hour;

(c) each component is weighed in a dry condition, and the weight recorded;

(d) each component is thereafter submerged in 70° F. water and gently agitated to assure that all air bubbles are removed from the void areas; and (e) each wetted component is thereafter removed from the water and immediately weighed, the weights being recorded The particular value for K is then calculated by the following relationship:

$$K = \frac{\Sigma \text{ (wet weight} - \text{dry weight for each component in the laminate sandwich)}}{\Sigma \text{ (wet weight for each component in the laminate sandwich)}}$$

Solving (4) for acceleration:

$$a = \frac{Pg}{\rho_H Ts K}. \quad (5)$$

The basic time-displacement equation is expressed as follows:

$$S = V_o t + \tfrac{1}{2} a t^2 \quad (6)$$

In the present instance,

Ts=S=total distance the free water contained in the sandwich must travel to exit the sandwich, Vo=O=initial velocity of the free water as measured in a direction perpendicular to the sandwich, and t=time required for the free water to travel the total thickness $T_s$ of the sandwich.

Therefore, $$S = T_s = \tfrac{1}{2} a t^2,$$

Substituting the value of acceleration "a" from (5) and solving for t:

$$t = T_s \sqrt{\frac{2\rho_H K}{Pg}} \quad (7)$$

Developing the equation to relate machine speed and nozzle orifice width to complete free water removal:

$$V \cdot t = W \quad (8)$$

where

V=papermachine speed, t=time required to remove the free water from the sandwich, and W=nozzle orifice width.

Substituting the value of time "t" from (7) in (8):

$$W = V \cdot T_s \sqrt{\frac{2\rho_H \cdot K}{Pg}} \quad (9)$$

Thus, for a given papermachine speed V, a given compressible fluid pressure P, an assumed saturated condition of the laminate sandwich comprising the foraminous support members and the fibrous web and a given water density $\rho$, the optimum nozzle orifice width W may be determined. Optimal sizing of the nozzle orifice W is extremely desirable to maximize dewatering efficiency while minimizing operating cost. If the nozzle orifice W is too small, the applied pressure of the compressible fluid will be unable to accelerate the free water sufficiently to permit complete removal of the free water from the sandwich. If, on the other hand, the nozzle orifice W is too large, most of the free water will be removed near the upstream edge of the orifice W, thereby allowing excessive quantities of the compressible fluid to pass through the dewatered sandwich prior to its reaching the downstream edge of the orifice. The increased compressible fluid requirements will adversely affect the economics of dewatering by this process.

It is, of course, herein recognized that the equation $P \leqq T/R$ assumes a foraminous support member of infinite flexibility. It is also recognized that usable foraminous support members do not meet this criteria. In order to make certain that a seal between the innermost foraminous support member 11 and the nozzle orifice W will be maintained in-use and that the laminate sandwich is capable of assuming the required in-use radius of curvature as a unified structure, a check must be made to insure that the minimum radius which each of the foraminous support members is capable of assuming does not exceed the minimum calculated values of R and $R_2$, determined as herein described. While mathematical techniques such as the flexural theory and energy principles described in the 1966 edition of *Advanced Mechanics of Materials* (Seely and Smith), said reference being hereby incorporated herein by reference, may be used to approximate the minimum radius of curvature which a given foraminous support member may assume, it is preferred in the practice of the present invention to install the particular foraminous support members in the manner herein disclosed and operate the system. An in-use check for leakage of the compressible fluid at the nozzle orifice and/or web disruption caused by separation of the laminate sandwich is then made while the foraminous support member furthest removed from the nozzle is operated at a tensile loading sufficiently below its yield point to avoid deformation. If either leakage or web disruption is detected, one or both of the foraminous support members is incapable of assuming the minimum radius required for the particular nozzle, and must be replaced with a more flexible support member or a larger radius must be employed on the nozzle.

In the preferred embodiment illustrated in cross-section in FIGS. 3 and 7, the Fourdrinier wire 11 comprises a plurality of cross-machine direction filaments having a diameter $D_{11}$ spaced at a pitch $P_{11}$, as measured in the machine direction, while the imprinting fabric 20 comprises a plurality of cross-machine direction filaments having a diameter $D_{20}$ spaced at a pitch $P_{20}$, as measured in the machine direction. The moist fibrous web 13 has an initial thickness "Y" prior to exposure to the orifice W in the slotted nozzle 30. The total amount of free water "X" contained between a pair of adjacent filaments in the Fourdinier wire 11 is schematically illustrated in FIG. 3. Several phenomena are apparent as the foraminous sandwich comprising Fourdinier wire 11, moist fibrous web 13 and imprinting fabric 20 are moved across the orifice W of the nozzle 30 at a velocity $V_1$. The compressible fluid supplied to the nozzle at pressure P begins to immediately exert a driving force against the free water upon exposure of the sandwich to the edge of the nozzle orifice. As the sandwich is advanced across the entire orifice W of the nozzle 30, a large portion of the free water "X'" is transported across the thickness of the web and is extruded between two or more adjacent filaments in the imprinting fabric 20. As the sandwich approaches the downstream edge of the nozzle orifice W, the quantity of free water X' displaced by the fluid jet has been brought from an initial position of rest to a velocity $V_2$ sufficient to expel it from the surface of the imprinting fabric 20 furthest removed from the nozzle 30 and into a suction box collecting chamber 31 located opposite the nozzle orifice W. The water is thereby moved through the foraminous sandwich and expelled from the structure as an atomized stream. Unlike prior art expulsion devices employing a plurality of exit perforations, the moisture is not required to travel laterally in the web to an exit point, but rather is transversely expelled from the laminate structure and consequently is unable to rewet the web upon removal of the driving force. The free water X' actually expelled from the laminate structure represents the bulk of the interstitial water contained in the laminate structure and at least a portion of the restrained water held to the individual fibers of the web and the individual filaments of the foraminous support members by surface tension.

Figure 4:
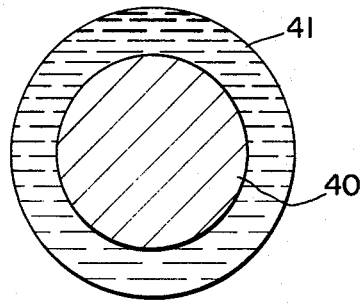
FIG. 4 is a simplified schematic cross-sectional illustration of a monofilament or fiber to which a film of moisture is secured by surface tension.
Figure 5:
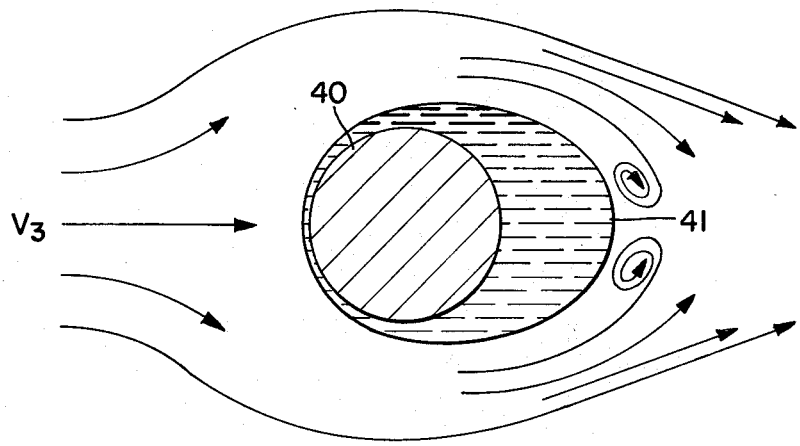
FIG. 5 is a cross-sectional illustration similar to that of FIG. 4, but showing the distortion of the moisture film created by a fast moving compressible fluid stream.
Figure 6:
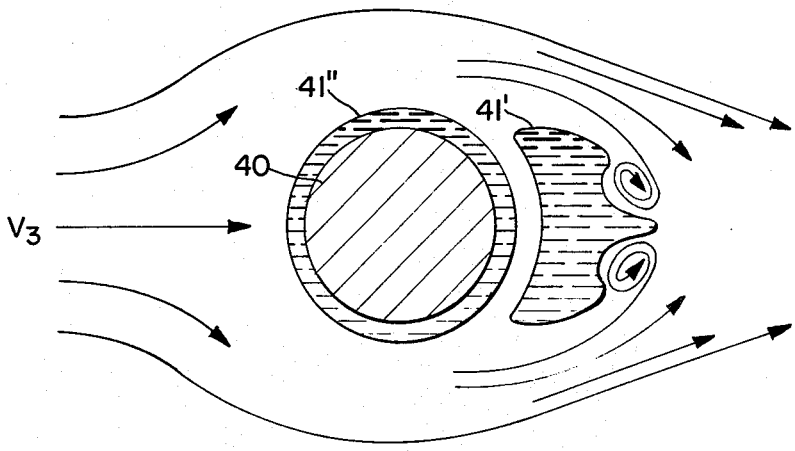
FIG. 6 is a cross-sectional illustration similar to that of FIG. 5, but showing removal of a portion of the film initially secured to the filament when the surface tension forces have been overcome by the turbulent rising pressure zone created by the fast-moving compressible fluid stream.

The mechanism by which a portion of the restrained water is removed from the laminate structure is best illustrated in FIGS. 4–6. FIG. 4 is a simplified schematic cross-sectional illustration of a single fiber or filament 40 to which a film of moisture 41 is held by surface tension. FIG. 4 represents an undisturbed condition of the fibers in the web 13 and the filaments in the foraminous support members 11 and 20 after removal of the interstitial water.

FIG. 5 depicts the initial movement of the surrounding water film as a separated flow condition begining to develop along the back side of the filament. The bulk of the restrained water film 41 in effect shifts to the rearwardmost surface of the filament 40. FIG. 6 illustrates the condition which prevails when the rising pressure vortices resulting from the turbulence generated at the rearwardmost surface of the filament 40 generate sufficient force to overcome the surface tension forces securing the film to the filament. A more complete explanation of the foregoing phenomenon is provided in the 1961 McGraw Hill editon of *Handbook of Fluid Mechanics* (Streeter) at Section 9, page 11, said reference being hereby incorporated herein by reference. The vortices serve to breakup the formed water volume at the rearwardmost surface of the filament into one or more droplets, since the thickness of the film has increased beyond the point where surface tension forces are able to restrain it. The droplets 41' are then removed from the laminate structure by the exiting stream of compressible fluid along with the interstitial water. The film of moisture 41'' remaining on the surface of the fiber or filament 40 may thereafter be removed by thermal means.

Another phenomenon illustrated in FIG. 3 is the increase in caliper of the fibrous web 13 from an initial thickness of "Y" prior to dewatering to a resultant thickness of "$Y+\Delta Y$" after dewatering in accordance with the present invention. The increase in thickness $\Delta Y$ represents the extent to which fibers in contact with the imprinting fabric 20 are reoriented and caused to penetrate the interstices existing between intersecting machine and cross-machine direction filaments in the imprinting fabric. It is, therefore, apparent that the present invention may be practiced to advantage not only in terms of greatly improved dewatering of a moist fibrous web, but also in terms of producing a web of significantly lower density than by known prior art dewatering processes when utilized in conjunction with a low density papermaking process such as that disclosed in the aforementioned patents to Sanford et al. and to Morgan et al.

As should be apparent from the foregoing description, the present invention may be practiced to advantage in any type of fibrous web forming operation wherein a moist fibrous web is constrained between a pair of foraminous support members capable of being directed in a unified condition across a slotted nozzle orifice in accordance with the relation $P<T/R$ where $T$=tension in the foraminous support member furthest removed from the nozzle and $R$= minimum radius of curvature said foraminous support member is capable of assuming across the nozzle orifice W without lift-off of the laminate sandwich at the nozzle.

Establishment of a continuous slot full width of the web, which is critical to the practice of the present invention, results in more efficient and more uniform dewatering than prior art perforated style expulsion devices in that the free water movement is substantially perpendicular to the surface of the web, thereby eliminating the lateral migration inherent in such prior art style devices. This minimizes rewetting of the web upon removal of the pressure driving force as is the case with discontinuous slots or perforations. Also, because of the relatively short distance the free water must travel to exit the web, the required residence time of the web over the nozzle orifice is considerably less than for prior art dewatering devices wherein the water must also be moved in a lateral direction in order to reach an exit point.

Because a moist fibrous web which has little cohesive strength at low fiber consistencies is constrained between a pair of foraminous support members in the practice of the present invention, much greater driving forces can be applied without causing web disruption which typically results if lift-off from the nozzle and separation of the laminate sandwich occurs. In this regard, it has been learned that with currently available foraminous support members pressures to approximatey 50 psig may be successfully employed to achieve the desired dewatering and bulking of the web. If is anticipated that with higher tensile strength foraminous support members and higher incoming fiber consistencies, pressures to approximately 100 psig could be employed.

The contribution of centrifugal force to overall dewatering efficiency is known to be directly proportional to the square of the machine speed and inversely proportional to the radius of curvature assumed by the laminate sandwich across the nozzle orifice W. While it is recognized that centrifugal force enters into the present process as an aid to dewatering due to the wrap of the laminate sandwich about the slotted nozzle 30, this is a negligible factor in relation to the extremely high dewatering efficiency of the present system.

Although a jet of compressed air is utilized for web dewatering and web bulking in a preferred embodiment of the present process, the present invention is not so limited. Any compressible fluid such as dry saturated or superheated steam will accomplish the same objective. Steam may also be utilized to increase water removal by reducing the viscosity and the surface tension of the water. Furthermore, heat provided by the steam can be utilized to vaporize a portion of the restrained water, thereby increasing the degree of water removal from the web. Unlike prior art vacuum systems, when the rate of moisture removal becomes limited by the amount of open or interstitial area in the laminate sandwich at a given pressure P, i.e., a choked flow condition is reached, the density of the compressible fluid jet driving the moisture from the web may be increased by raising the operating pressure P. Raising the pressure increases the driving force acting on the fluid being expelled and consequently increases the rate of water expulsion. Substantially increasing the operating pressure P of the jet would, of course, necessitate increasing the tension T in the outermost foraminous support member to prevent lift-off of the sandwich at the nozzle.

By employing process and apparatus of the present invention to remove the bulk of free water from a moist fibrous web prior to thermal predrying by hot air dryers of the type generally described in the aforementioned patent to Sisson et al., it has been determined that the overall thermal energy drying requirements to achieve an equivalent fiber consistency may be reduced by as much as 25 to 30 percent. Alternatively, on papermaking machines wherein drying capability is the limiting speed factor, the present invention may be utilized to advantage in the form of increased production speed without increasing the thermal energy requirements of the papermachine. In this regard, it has been determined that production capacity may be increased by as much as 25 to 30 percent without increasing the thermal energy requirements of the papermachine.

In an exemplary embodiment of the present invention, a slotted nozzle having an orifice W of approximately 0.10 inches in width, a radius of cruvature $R_1$ determined as herein set forth of approximately 0.5 inches, defined through an included angle $\alpha$ amounting to approximately 18 degrees, and operating with compressed air at a pressure of approximately 40 psig was used to reduce the moisture content of a moist fibrous web having a finished uncreped basis weight of approximately 15 pounds per 3,000 square feet from an incoming fiber consistency of approximately 4.00 lb. of water per lb. of fiber to an outgoing fiber consistency of approximately 2.96 lb. of water per lb. of fiber. The moist fibrous web was drawn across said nozzle while in a unified, laminate sandwich having a total thickness Ts amounting to approximately 0.059 inches, said web being constrained between a 78 machine direction by 56 cross-machine direction four-shed, satin weave Fourdrinier wire comprised of plastic wire filaments having a common diameter of approximately 0.008 inches and a 31 machine direction by 25 cross-machine direction semi-twill weave imprinting fabric comprised of plastic filaments having a common diameter of approximately 0.02 inches, at an operating speed of 3,000 feet per minute. The nozzle was utilized in conjunction with a suction box to collect the free water expelled from the laminate sandwich.

While the present invention has been described and illustrated in terms of a single slotted nozzle operating in conjunction with a suction box, it is recognized that the present invention may be practiced to advantage, either with or without suction, by utilizing a series of such nozzles located in sequential fashion on the same or on both sides of the forminous sandwich to maximize the dewatering effect prior to subjecting the web to thermal predrying or final drying.

The bulk increase described in connection with FIG. 3 produces an apparent increase in finsihed product softness due to the lower density of the resultant structure as well as the surface impression formed on the web by the foraminous support member. In this regard, it should be noted that the present invention may also be practiced to advantage by installing a multiplicity of slotted nozzles of the type described herein in series with one another and located on opposite surfaces of the foraminous supporting members so as to produce the impression of a foraminous carrying member on both surfaces of the resultant web. Thus, the characteristics of the foraminous membranes are important in determining not only dewatering efficiency, but also the surface feel of the finished product. Characteristics such as filament diameter, mesh count, amount of open or interstitial area and type of weave all impact on both the dewatering efficiency of the present process and the finished product attributes. In general, the greater the percentage open area of the foraminous support members, the greater will be the dewatering effect provided by the present invention. On the other hand, the greater the percentage open area of the foraminous support members and less support will be provided to the web, thus necessitating the use of lower pressures in order to avoid excessive discharge of fibers completely through the laminate sandwich during the dewatering operation.

It is to be understood that the forms of the invention herein illustrated and described are to be taken as preferred embodiments. Various modification will be apparent to those skilled in the art.

Having thus defined and described the invention, what is claimed is:

1. In a low-density papermaking process wherein overall compaction of the traveling fibrous paper web is avoided, the improvement comprising a nondestructive method for expelling a continuous atomized stream of moisture from said traveling moist fibrous web, said method comprising the steps of;

(a) constraining said moist fibrous web between a first traveling foraminous support member comprised of a plurality of spaced longitudinal filaments extending generally in the machine direction interwoven with a plurality of spaced transverse filaments extending generally in the cross-machine direction and a second traveling foraminous support member comprised of a plurality of spaced longitudinal filaments extending generally in the machine direction interwoven with a plurality of spaced transverse filaments extending generally in the cross-machine direction to form a unified traveling composite structure;

(b) directing said first traveling foraminous support member of said composite structure across the surface of a stationary pressure plenum connected to a source of compressible fluid maintained at pressure, P, said pressure plenum having a slotted orifice extending continuously in a direction substantially perpendicular to the direction of travel of said composite structure across the entire width of said moist fibrous web;

(c) applying tension, T, to said second foraminous support member as said composite structure crosses said slotted orifice in accordance with the relation $T > P \times R$, where P=pressure of the compressible fluid supplied to said stationary plenum and R=minimum radius of curvature said second traveling foraminous support member is capable of assuming across said slotted orifice such that said composite structure is maintained in a unified condition and said first traveling foraminous support member is maintained in sealed relation to said slotted orifice; and (d) directing a continuous jet of said compressible fluid from said slotted orifice directly through said composite structure as it crosses said slotted orifice, thereby expelling a continuous atomized stream of moisture across the entire width of said traveling moist fibrous web.

2. The method of claim 1, wherein said moist fibrous web is constrained by supporting said moist fibrous web on said first traveling foraminous support member and thereafter superposing on said moist fibrous web and said first traveling foraminous support member a second traveling foraminous support member to form a traveling composite structure.

3. The method of claim 2, wherein said moist fibrous web is formed directly on said first traveling foraminous support member.

4. The method of claim 3, wherein said first traveling foraminous support member comprises a Fourdrinier wire and said second traveling foraminous support member comprises an imprinting fabric.

5. The method of claim 1, wherein said moist fibrous web is formed directly between said first traveling foraminous support member and said second traveling foraminous support member.

6. The method of claim 1, including the step of applying suction to the surface of said second traveling foraminous support member opposite said slotted orifice in said pressure plenum, thereby collecting the moisture expelled from said traveling composite structure.

7. The method of claim 1 including the step of separating said first traveling foraminous support member from said composite structure after directing said jet of compressible fluid through said composite structure, said fibrous web remaining in contact with said second traveling foraminous support member.

8. The method of claim 1, wherein said compressible fluid is comprised of air.

9. The method of claim 1, wherein said compressible fluid is comprised of steam.

10. In a low density papermaking machine wherein overall compaction of the traveling web is avoided, the improvement comprising a nondestructive fibrous web dewatering apparatus, comprising:

(a) a first traveling foraminous support member comprised of a plurality of spaced longitudinal filaments extending generally in the machine direction interwoven with a plurality of spaced transverse filaments extending generally in the cross-machine direction, said member having an interior and an exterior surface, the exterior surface of said foraminous support member contacting and supporting said moist fibrous web;

(b) a stationary pressure plenum connected to a source of compressible fluid maintained at pressure, P, said pressure plenum having a slotted orifice extending continuously in a direction substantially perpendicular to the direction of travel of said first traveling foraminous support member across the entire width of said moist fibrous web;

(c) a second tension controlled foraminous support member comprised of a plurality of spaced longitudinal filaments extending generally in the machine direction interwoven with a plurality of spaced transverse filaments extending generally in the cross-machine direction in superposed relation to and traveling with said moist fibrous web and said first traveling foraminous support member to form a composite structure therewith; and (d) means for applying tension, T, to said second foraminous support member as said composite structure travels across said slotted orifice in accordance with the relation $T > P \times R$, where P=pressure of the compressible fluid supplied to said stationary plenum, and R=minimum radius of curvature which said second traveling foraminous support member is capable of assuming across said slotted orifice such that said second traveling foraminous support member, said moist fibrous web and said first foraminous support member are maintained in a unified condition and the interior surface of said first traveling foraminous support member is maintained in sealed relation to said slotted orifice.

11. The apparatus of claim 10, including means for applying suction to the surface of said second traveling foraminous support member opposite said slotted orifice in said pressure plenum.

12. The apparatus of claim 10, including means for adjusting the width of said slotted orifice.

13. The apparatus of claim 10, including means for adjusting the tension, T, applied to said second foraminous support member.

14. The apparatus of claim 10 wherein the sealing surfaces of said pressure plenum adjacent the edges of said slotted orifice exhibit a radius of curvature equal to the minimum radius of curvature which the interior surface of said first traveling foraminous support member is capable of assuming across said slotted orifice when said composite structure is maintained in a unified condition and said first traveling foraminous support member is maintained in sealed relation to said slotted orifice.

15. The apparatus of claim 14, wherein said sealing surfaces of said pressure plenum extend a sufficient distance on each side of said slotted orifice to substantially prevent the escape of said compressible fluid through portions of said first traveling foraminous support member not in direct alignment with said slotted orifice.

16. The apparatus of claim 10, wherein said pressure plenum has a slotted orifice of width, W, sufficient to completely expel the free water contained in the laminate sandwich comprising said first foraminous support member, said moist fibrous web and said second foraminous support member, said width being defined by the relation $$W = V \cdot Ts \sqrt{\frac{2\rho_H K}{Pg}}$$

where

V=paper machine speed,

Ts=total thickness of the composite structure comprising said first traveling foraminous support member, said moist fibrous web and said second traveling foraminous support member, $\rho$H=density of the moisture contained in said composite structure, P=pressure of said compressible fluid, g=acceleration due to gravity, and K=ratio of the weight of the free water contained in the saturated composite structure to the total weight of said saturated composite structure.

* * * * *

UNITED STATES PATENT AND TRADEMARK OFFICE

CERTIFICATE OF CORRECTION

PATENT NO. : 4,157,938

DATED : June 12, 1979

INVENTOR(S) : MATTHEW L. CLEMENS and WENDELL J. MORTON

It is certified that error appears in the above-identified patent and that said Letters Patent are hereby corrected as shown below:

Column 1, line 42, "continous" should read -- continuous --.

Column 2, line 11, "formainous" should read -- foraminous --.

Column 3, line 62, "pressure" should read -- pressed --.

Column 4, line 39, "utilizng" should read -- utilizing --.

Column 5, line 15, "Fourdinier" should read -- Fourdrinier --.

Column 5, line 16, "Fourdinier" should read -- Fourdrinier --.

Column 5, line 20, "Fourdinier" should read -- Fourdrinier --.

Column 5, line 25, "Fourdinier" should read -- Fourdrinier --.

Column 5, line 28, "Fourdinier" should read -- Fourdrinier --.

Column 5, line 39, "Fourdinier" should read -- Fourdrinier --.

Column 5, line 39, "subject" should read -- subjected.

Column 5, lines 53-54, "impriting" should read -- imprinting --.

Column 5, line 59, "Fourdinier" should read -- Fourdrinier --.

Column 6, line 27, "Fourdinier" should read -- Fourdrinier --.

Column 6, line 27, "impriting" should read -- imprinting --.

Column 6, line 37, "I" should read -- T --.

UNITED STATES PATENT AND TRADEMARK OFFICE

CERTIFICATE OF CORRECTION

PATENT NO. : 4,157,938 Page 2 of 2

DATED : June 12, 1979

INVENTOR(S) : MATTHEW L. CLEMENS and WENDELL J. MORTON

It is certified that error appears in the above-identified patent and that said Letters Patent are hereby corrected as shown below:

Column 7, line 38, "foraminuous" should read -- foraminous --.

Column 8, line 10, "Ma" should read -- M --.

Column 8, line 41, "$\rho$" should read --$\rho_H$ --.

Column 8, line 66, after "recorded", insert -- . --.

Column 9, line 55, "$\rho$," should read --$\rho_H$ , --.

Column 10, line 48, "Fourdinier" should read -- Fourdrinier --.

Column 10, line 51, "Fourdinier" should read -- Fourdrinier --.

Column 11, line 24, "begining" should read -- beginning --.

Column 12, line 33, "approximatey" should read -- approximately --.

Column 12, line 35, "If" should read -- It --.

Column 13, line 53, "forminous" should read -- foraminous --.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*